US012532997B2

(12) United States Patent
Lubbers et al.

(10) Patent No.: US 12,532,997 B2
(45) Date of Patent: Jan. 27, 2026

(54) NOZZLE ARRANGEMENT CONFIGURED TO FACE A SURFACE TO BE CLEANED

(71) Applicant: KONINKLIJKE PHILIPS N.V., Eindhoven (NL)

(72) Inventors: Matthijs Hendrikus Lubbers, Eindhoven (NL); Jonne Steeman, Eindhoven (NL); Renee Luijkx, Eindhoven (NL); Rogier De Vrind, Eindhoven (NL)

(73) Assignee: VERSUNI HOLDING B.V., Eindhoven (NL)

( * ) Notice: Subject to any disclaimer, the term of this patent is extended or adjusted under 35 U.S.C. 154(b) by 118 days.

(21) Appl. No.: 17/640,063

(22) PCT Filed: Apr. 9, 2021

(86) PCT No.: PCT/EP2021/059335
§ 371 (c)(1),
(2) Date: Mar. 3, 2022

(87) PCT Pub. No.: WO2021/213819
PCT Pub. Date: Oct. 28, 2021

(65) Prior Publication Data

US 2023/0023793 A1 Jan. 26, 2023

(30) Foreign Application Priority Data

Apr. 20, 2020 (EP) ..... 20170322

(51) Int. Cl.
*A47L 9/06* (2006.01)
*A47L 9/00* (2006.01)

(52) U.S. Cl.
CPC ..... *A47L 9/0666* (2013.01); *A47L 9/0072* (2013.01); *A47L 9/0673* (2013.01); *A47L 9/0686* (2013.01)

(58) Field of Classification Search
CPC ..... A47L 5/24; A47L 13/254; A47L 13/256; A47L 13/258; A47L 13/255; A47L 13/24;
(Continued)

(56) References Cited

U.S. PATENT DOCUMENTS

2009/0089961 A1 4/2009 Kim et al.
2014/0033468 A1* 2/2014 Guder ..... A47L 9/248 15/415.1

(Continued)

FOREIGN PATENT DOCUMENTS

CN 104706277 A 6/2015
DE 102008033537 A1 1/2010

(Continued)

OTHER PUBLICATIONS

Extended European Search Report issued in connection with corresponding EP Application No. 20170322.0 dated Sep. 24, 2020.

(Continued)

*Primary Examiner* — Brian D Keller
*Assistant Examiner* — John C Merino
(74) *Attorney, Agent, or Firm* — Maschoff Brennan

(57) ABSTRACT

A nozzle arrangement faces a surface to be cleaned includes a first suction body and a second suction body located at a distance relative to each other. The nozzle arrangement further includes a level setting mechanism that puts the first suction body and the second suction body at different overall levels relative to the surface in a normal, operational orientation of the nozzle arrangement on the surface. In this way, cleaning performance of the nozzle arrangement can be improved. Additionally, or alternatively, it is possible to have a suction enhancing mechanism for at least partially closing at least one of the first suction body and the second suction body to one of the surface and an internal air conduit of the nozzle arrangement.

16 Claims, 4 Drawing Sheets

(58) Field of Classification Search
CPC ..... A47L 9/02; A47L 9/068; A47L 9/0666; A47L 9/0686; A47L 9/242
See application file for complete search history.

(56) References Cited

U.S. PATENT DOCUMENTS

| | | | | |
|---|---|---|---|---|
| 2014/0033472 | A1 | 2/2014 | Dyson | |
| 2018/0235425 | A1* | 8/2018 | Ding | A47L 11/282 |
| 2019/0075984 | A1* | 3/2019 | James | A47L 9/00 |
| 2019/0380555 | A1* | 12/2019 | Scott | A47L 11/4094 |
| 2020/0359863 | A1* | 11/2020 | Brugora | A47L 11/4044 |

FOREIGN PATENT DOCUMENTS

| | | | | |
|---|---|---|---|---|
| JP | S62-30753 | U | 2/1987 | |
| JP | H06-36550 | U | 5/1994 | |
| JP | 2000-041912 | A | 2/2000 | |
| JP | 2001-327442 | A | 11/2001 | |
| JP | 2003-525079 | A | 8/2003 | |
| JP | 5443876 | B2 | 3/2014 | |
| JP | 2016-016003 | A | 2/2016 | |
| KR | 10-2002-0077404 | A | 10/2002 | |
| KR | 10-2005-0088903 | A | 9/2005 | |
| KR | 20090102571 | A | 9/2009 | |
| KR | 10-2014-0086592 | A | 7/2014 | |
| KR | 10-2024465 | B1 | 9/2019 | |
| WO | 0154555 | A1 | 8/2001 | |
| WO | 2008028763 | A1 | 3/2008 | |
| WO | 2011007158 | A1 | 1/2011 | |
| WO | WO-2019170265 | A1 * | 9/2019 | A47L 11/302 |

OTHER PUBLICATIONS

International Search Report and Written Opinion issued in connection with corresponding PCT Application No. PCT/EP2021/059335 dated Jul. 2, 2021.

* cited by examiner

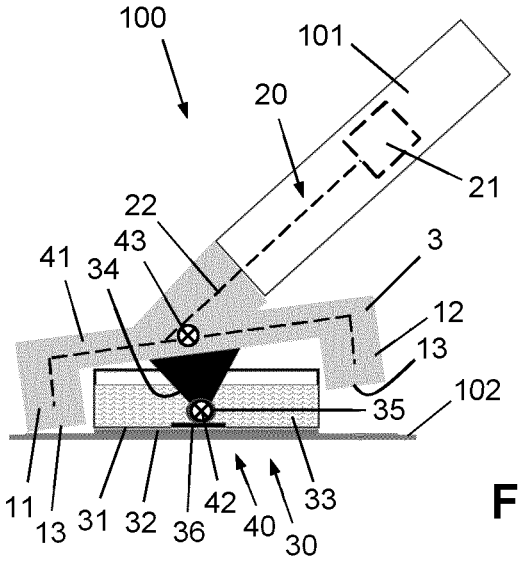
Fig. 4
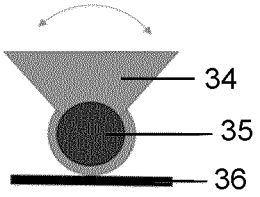
Fig. 5
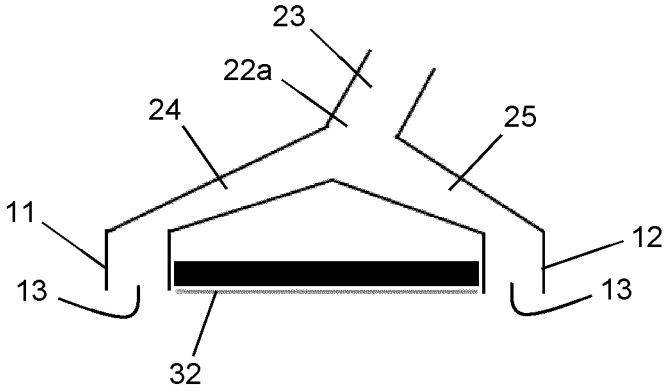
Fig. 6
Fig. 7
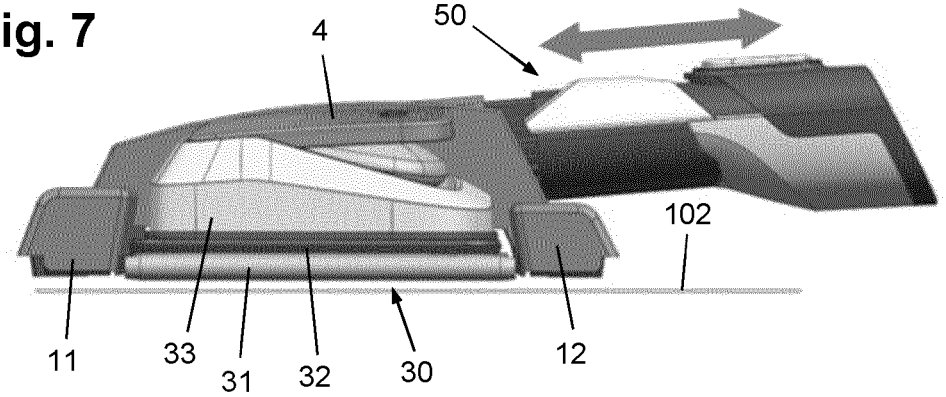

NOZZLE ARRANGEMENT CONFIGURED TO FACE A SURFACE TO BE CLEANED

CROSS-REFERENCE TO RELATED APPLICATIONS

The present application is a U.S. National Phase application under 35 U.S.C. § 371 of International Application No. PCT/EP2021/059335, filed on Apr. 9, 2021, which claims the benefit of European Patent Application No. 20170322.0, filed on Apr. 20, 2020. These applications are hereby incorporated by reference herein.

FIELD OF THE INVENTION

The invention relates to a nozzle arrangement configured to face a surface to be cleaned, comprising a first suction body and a second suction body located at a distance relative to each other, wherein both the first suction body and the second suction body are configured to be operated to suck dust and dirt from the surface to be cleaned, and wherein both the first suction body and the second suction body are connectable to a mechanism configured to create underpressure at the position of the first suction body and the second suction body.

Further, the invention relates to a cleaning appliance, comprising a nozzle arrangement as mentioned, a handle that is connectable to the nozzle arrangement for allowing a user of the cleaning appliance to control the position of the nozzle arrangement relative to a surface to be cleaned, and a mechanism configured to create underpressure at the position of the first suction body and the second suction body of the nozzle arrangement.

BACKGROUND OF THE INVENTION

Cleaning of a hard floor is traditionally done by first subjecting the floor to a vacuuming action, and subsequently subjecting the floor to a mopping action. As a result of the vacuuming action, dust and particles are removed from the floor, while the mopping action is intended to remove stains from the floor. Nowadays, cleaning appliances are available which are designed to vacuum and mop in one go. In general, such cleaning appliances comprise a nozzle arrangement configured to face a surface to be cleaned, and a handle that is connectable to the nozzle arrangement for allowing a user of the cleaning appliance to control the position of the nozzle arrangement relative to the surface. For the purpose of allowing such cleaning appliances to perform a vacuuming action, the cleaning appliances are equipped with a vacuum mechanism configured to create underpressure at the position of the nozzle arrangement, particularly at the position of at least one suction body of the nozzle arrangement that is configured to be operated to suck dust and dirt from the surface and that is connectable to the vacuum mechanism. Further, for the purpose of allowing such cleaning appliances to perform a mopping action, the nozzle arrangement is equipped with a mopping assembly.

In practical cases, the mopping assembly of the nozzle arrangement comprises a mop holder configured to support a mopping element configured to be wetted, wherein normally a piece of cloth is used as the mopping element. The mopping assembly may also comprise a liquid tank configured to contain liquid to be supplied to the mopping element for wetting the mopping element. In such a case, the mop holder and the liquid tank may be integrated.

One of the main issues in the field of cleaning appliances which are capable of simultaneously performing a vacuuming action and a mopping action on a surface to be cleaned is that it is desired to keep the mopping element as clean as possible. In view thereof, it is advantageous if the nozzle arrangement is provided with two suction bodies. The fact is that a cleaning appliance can and will be used in a bi-directional way, wherein the user alternately pushes and pulls the cleaning appliance so as to alternately move away from her/him and towards her/him. When the nozzle arrangement is designed such that the mop holder is sandwiched between two suction bodies, it can be achieved that there is always a suction body in front of the mopping element, regardless of the direction of movement of nozzle arrangement. However, it is also achieved that there is always a suction body behind the mopping element, which results in the appearance of stripes on the wet surface. It may further happen that the suction bodies get dirty as they are wetted to some extent as a consequence of exposure to the wet surface each time they are in a trailing position.

WO0154555A1 relates to a cleaning head for a floor-cleaning device, comprising the following: at least one nozzle, which can be connected to a cleaning product supply for applying a cleaning product in vapor or liquid form to a floor surface to be cleaned; a front suction opening and a back suction opening (in relation to the direction of advancement of the cleaning head) for taking up dirt and used cleaning product, which can be connected to a suction assembly; and front and back squeegee-type lip elements which are associated with the suction openings and which can be lowered onto or raised from the floor surface according to the advancing movement.

WO2011007158A1 relates to a surface treating head in the form of a floor tool for a vacuum cleaner, which includes a main body, a suction cavity and an outlet. The suction cavity comprises first and second suction channels, bounded on both sides by respective working edges. A fluid flow path extends from the first suction channel to the second suction channel and from there to the outlet. The plurality of suction channels permits effective pick-up of dirt. To enable the surface treating head to be used to treat both carpeted floor surfaces and hard floor surfaces, the surface treating head may be provided with a brush unit and a drive mechanism for moving the brush unit between a stowed position and a deployed position.

WO2008/028763 A1 relates to a hard floor nozzle which is suitably designed for vacuum-cleaning and wiping. The aim of the invention is to ensure that the wiper element is evenly kept moist. For this purpose, the floor nozzle has an element for keeping away from a wiper element support for a moist wiper element the suction air flow produced during vacuum-cleaning.

US2014/033472A1 relates to a floor tool for a vacuum cleaning appliance comprising a support member for supporting a cleaning element and at least one suction nozzle in communication with a conduit, wherein the conduit includes one or more plug elements that are engageable with respective sockets provided in the conduits, the plugs being removable from the sockets to provide access to the interior of the conduit. The invention therefore provides a floor tool combining suction and wipe cleaning facilities with improved maintainability for the user.

SUMMARY OF THE INVENTION

It is an object of the invention to alleviate the problems addressed in the foregoing, i.e. the problems which occur in the field of cleaning appliances which are designed to vacuum and mop in one go and which are associated with the concept of having two suction bodies in a nozzle arrangement of the cleaning appliance so that there can always be a suction body in front of the mopping element.

In view of the foregoing, the invention provides a nozzle arrangement configured to face a surface to be cleaned, comprising i) a first suction body and a second suction body located at a distance relative to each other, wherein both the first suction body and the second suction body are configured to be operated to suck dust and dirt from the surface to be cleaned, and wherein both the first suction body and the second suction body are connectable to a mechanism configured to create underpressure at the position of the first suction body and the second suction body, and ii) a level setting mechanism configured to put the first suction body and the second suction body at different overall levels relative to the surface to be cleaned in a normal, operational orientation of the nozzle arrangement on the surface.

The invention also relates to a cleaning appliance, comprising a nozzle arrangement as defined in the preceding paragraph, a handle that is connectable to the nozzle arrangement for allowing a user of the cleaning appliance to control the position of the nozzle arrangement relative to a surface to be cleaned, and a mechanism configured to create underpressure at the position of the first suction body and the second suction body of the nozzle arrangement.

According to the invention, the problem addressed in the foregoing is alleviated when adjustments are made to the design of the nozzle arrangement, especially when the nozzle arrangement is equipped with a level setting mechanism that is configured to put the first suction body and the second suction body at different overall levels relative to the surface to be cleaned in a normal, operational orientation of the nozzle arrangement on the surface. On the basis of the presence of the level setting mechanism, it is possible to control the overall level of each of the suction bodies in a suitable fashion, wherein each of the suction bodies is put to a low overall level relative to the surface during the time that the suction body is in a leading position, which may be a level in which the suction body contacts the surface, and wherein each of the suction bodies is put to a higher overall level relative to the surface during the time that the suction body is in a trailing position. Examples of ways in which this can be done are provided in the following. By providing the nozzle arrangement with the level setting functionality, it is achieved that the nozzle arrangement can be of the directional type that is suitable to be moved in two opposite directions without the risk of the suction bodies reducing cleaning performance and getting contaminated even though they are still alternately put to a leading position and a trailing position.

In a practical embodiment of the nozzle arrangement according to the invention, the level setting mechanism is configured to put the first suction body at a lower overall level relative to the surface to be cleaned and the second suction body at a higher overall level relative to the surface when the nozzle arrangement is subjected to a force related to a movement of the nozzle arrangement with the first suction body at a leading position and the second suction body at a trailing position, and to put the second suction body at a lower overall level relative to the surface to be cleaned and the first suction body at a higher overall level relative to the surface when the nozzle arrangement is subjected to a force related to a movement of the nozzle arrangement with the second suction body at a leading position and the first suction body at a trailing position. Thus, in this embodiment, the level setting mechanism is configured to respond to the pushing force or the pulling force as may be exerted on the nozzle arrangement by a user and set the levels of the suction bodies such that only the suction body that is at a leading position is at a lower overall level relative to the surface and that the other suction body is at a higher overall level relative to the surface.

It is practical if the level setting mechanism comprises an element interconnecting the first suction body and the second suction body, which element is movably arranged in the nozzle arrangement. In this way, the level setting mechanism is allowed to set the appropriate levels of the suction bodies in a mechanical fashion, without a need for complex (electronic) controlling components. For example, the level setting mechanism may comprise a carrier of the first suction body and the second suction body that is tiltable about a tilting axis in the nozzle arrangement, wherein the first suction body is connected to the carrier at a location at one side of the tilting axis and the second suction body is connected to the carrier at a location at the other side of the tilting axis so that in the normal, operational orientation of the nozzle arrangement on the surface to be cleaned, the first suction body and the second section body move in opposite directions relative to the surface as the carrier tilts. Such a carrier can be arranged in the nozzle arrangement in such a way that an appropriate tilted orientation of the carrier is set in dependence of the direction of the force that is exerted on the nozzle arrangement when the nozzle arrangement is moved along the surface to be cleaned. Assuming that the tilting axis is at a level between a point of application of the force on the nozzle arrangement and an area of contact to the surface, the combination of the force acting on the point of application and a friction force acting at the area of contact to the surface causes the carrier to be subjected to torque acting to bring about a tilting movement of the carrier about the tilting axis. When the direction of the force acting on the point of application changes, the direction of the torque changes and a tilting movement of the carrier from a first setting position to a second setting position actually takes place. The first setting position and the second setting position may be determined by the relevant suction body contacting the surface or may be predetermined by means of suitable stops or the like in the nozzle arrangement.

In conformity with what has already been explained in the foregoing in respect of conventional nozzle arrangements, it may be so that the nozzle arrangement according to the invention comprises a mopping assembly that is configured to perform a mopping action on the surface to be cleaned when the nozzle arrangement is moved along the surface, wherein the first suction body and the second suction body are located on either side of the mopping assembly. In particular, in that case, it is advantageous if the mopping assembly comprises a mop holder that is configured to support a mopping element configured to be wetted, wherein the mopping element is attachable to and detachable from the mop holder.

The first suction body, the second suction body and at least a component of the mopping assembly may be jointly movable in the nozzle arrangement. For example, the mop holder and the above-mentioned movable element of the level setting mechanism interconnecting the first suction body and the second suction body may be integrated. In such a case, it is practical if the mop holder is designed so as to realize a convex outline of the mopping element, which facilitates a tilting movement of the mop holder supporting the mopping element over the surface to be cleaned, wherein a tilting axis of the integral entirety of the first suction body, the second suction body and the mop holder supporting the mopping element is at a position of contact of the mopping element to the surface.

According to a further possibility, the mopping assembly may comprise a liquid tank that is configured to contain liquid to be supplied to the mopping element for wetting the mopping element. In such a case, the mop holder and the liquid tank may be integrated, wherein the liquid tank may serve for supporting the mopping element. Examples of liquid to be supplied to the mopping element are water and a mixture of water and a cleaning agent such as soap. It is advantageous if the mopping assembly is removably arranged in the nozzle arrangement, as this allows for easy cleaning of the components of the mopping assembly and/or filling of the liquid tank by a user. In this respect, it is noted that any suitable way of attaching the mopping assembly to and detaching the mopping assembly from a support in the nozzle arrangement may be chosen. For example, a magnet connection may be utilized, wherein at least one of the mopping assembly and the support may be equipped with at least one magnet, so that a connection may be made through two cooperating magnets, for example, or a magnet and a metal plate. Alternatively, one of the mopping assembly and the support may comprise a cylindric feature and the other of the mopping assembly and the support may comprise an elastic feature for receiving the cylindric feature, wherein a sufficiently strong connection between the mopping assembly and the support is established as soon as the cylindric feature has snapped into the elastic feature.

It is noted that the first suction body and the second suction body may be of any suitable design. For example, it may be practical if the suction bodies are of generally elongated appearance, being designed like channels having an open suction area at a side facing the surface to be cleaned in the normal, operational orientation of the nozzle arrangement on the surface. It is a known fact that assuming a certain vacuum generation capacity, effectiveness of the vacuuming functionality decreases when the size of the suction areas defined by the suction bodies increases. In view thereof, it is particularly advantageous when the nozzle arrangement further comprises a suction enhancing mechanism for at least partially closing at least one of the first suction body and the second suction body to one of the surface to be cleaned and an internal air conduit of the nozzle arrangement. This particularly allows for at least partially closing the suction body that is at a trailing position and therefore at a high overall level relative to the surface. Thus, assuming that the nozzle arrangement is alternately pushed forward and pulled backward during use, the suction bodies may alternately be at least partially closed and fully opened, in harmony with the continuous process of switching between leading and trailing positions. Generally speaking, the suction enhancing mechanism may be configured to control an opened/closed condition of the at least one of the first suction body and the second suction body in relation to a direction of a force exerted on the nozzle arrangement for moving the nozzle arrangement.

In order to control the size of the suction areas defined by the suction bodies in an advantageous fashion, it is practical if the suction enhancing mechanism is configured to at least partially close the second suction body while leaving the first suction body open when the nozzle arrangement is subjected to a force related to a movement of the nozzle arrangement with the first suction body at a leading position and the second suction body at a trailing position, and to at least partially close the first suction body while leaving the second suction body open when the nozzle arrangement is subjected to a force related to a movement of the nozzle arrangement with the second suction body at a leading position and the first suction body at a trailing position.

It may particularly be practical if the suction enhancing mechanism is arranged to be controlled by the level setting mechanism. For example, the way in which the suction enhancing mechanism controls the size of the suction areas defined by the suction bodies may be directly related to a position of one or more components of the level setting mechanism in the nozzle arrangement. In any case, like the level setting mechanism, the suction enhancing mechanism can function in a mechanical fashion and can do without complex (electronic) controlling components.

It is to be noted that the concept of having a suction enhancing mechanism as defined in the foregoing can be applied independently of the concept of having a level setting mechanism as defined in the foregoing. Hence, the invention also relates to a nozzle arrangement configured to face a surface to be cleaned, comprising i) a first suction body and a second suction body located at a distance relative to each other, wherein both the first suction body and the second suction body are configured to be operated to suck dust and dirt from the surface to be cleaned, and wherein both the first suction body and the second suction body are connectable to a mechanism configured to create underpressure at the position of the first suction body and the second suction body, and ii) a suction enhancing mechanism for at least partially closing at least one of the first suction body and the second suction body to one of the surface to be cleaned and an internal air conduit of the nozzle arrangement. Options as mentioned in the foregoing are equally applicable, especially the option of the suction enhancing mechanism being configured to at least partially close the second suction body while leaving the first suction body open when the nozzle arrangement is subjected to a force related to a movement of the nozzle arrangement with the first suction body at a leading position and the second suction body at a trailing position, and to at least partially close the first suction body while leaving the second suction body open when the nozzle arrangement is subjected to a force related to a movement of the nozzle arrangement with the second suction body at a leading position and the first suction body at a trailing position.

Another option which is equally applicable is the option of the nozzle arrangement comprising a mopping assembly configured to perform a mopping action on the surface to be cleaned when the nozzle arrangement is moved along the surface, wherein the first suction body and the second suction body are located on either side of the mopping assembly. As explained, in the context of this option, it may be so that the mopping assembly comprises a mop holder configured to support a mopping element configured to be wetted, wherein the mopping element is attachable to and detachable from the mop holder, and it may further be so that the mopping assembly comprises a liquid tank configured to contain liquid to be supplied to the mopping element for wetting the mopping element, wherein optionally the mop holder and the liquid tank are integrated. Also, as explained, the mopping assembly may be removably arranged in the nozzle arrangement, wherein it may be practical if the mopping assembly is attachable to and detachable from a support in the nozzle arrangement through a magnet connection involving at least one magnet in at least one of the mopping assembly and the support, which does not alter the fact that other attachment and detachment mechanisms are feasible as well. It is noted that the first suction body and the second suction body may be of any suitable design.

Also in the context of the nozzle arrangement comprising the suction enhancing mechanism but not necessarily comprising the level setting mechanism, it may be practical if the suction bodies are of generally elongated appearance, being designed like channels having an open suction area at a side facing the surface to be cleaned in the normal, operational orientation of the nozzle arrangement on the surface. The invention also relates to a cleaning appliance comprising the nozzle arrangement besides a handle that is connectable to the nozzle arrangement for allowing a user of the cleaning appliance to control the position of the nozzle arrangement relative to a surface to be cleaned, and a vacuum mechanism configured to create underpressure at the position of the first suction body and the second suction body of the nozzle arrangement.

The above-described and other aspects of the invention will be apparent from and elucidated with reference to the following detailed description of practical embodiments of a nozzle arrangement that is configured to face a surface to be cleaned and that is intended for use in a cleaning appliance.

BRIEF DESCRIPTION OF THE DRAWINGS

The invention will now be explained in greater detail with reference to the figures, in which equal or similar parts are indicated by the same reference signs, and in which:

FIG. 5 shows an enlarged view of components of a magnet connection included in the nozzle arrangement of FIG. 4, FIG. 6 diagrammatically shows a conduit system as present in a nozzle arrangement and a mopping element located between two suction bodies of the nozzle arrangement, FIG. 7 diagrammatically shows a side view of a nozzle arrangement according to a fourth embodiment of the invention, and a portion of a handle of a cleaning appliance connected to the nozzle arrangement, FIG. 8 diagrammatically shows a sectional view of a valve arrangement of the nozzle arrangement of FIG. 7, FIG. 9 diagrammatically shows a conduit system as present in a nozzle arrangement according to a fifth embodiment of the invention, and also shows a mopping arrangement of the nozzle arrangement, FIG. 10 diagrammatically shows a side view of a nozzle arrangement according to a sixth embodiment of the invention, and a portion of a handle of a cleaning appliance connected to the nozzle arrangement, and FIG. 11 diagrammatically shows a side view of a nozzle arrangement according to a seventh embodiment of the invention, and a portion of a handle of a cleaning appliance connected to the nozzle arrangement.

DETAILED DESCRIPTION OF EMBODIMENTS

Figure 1:
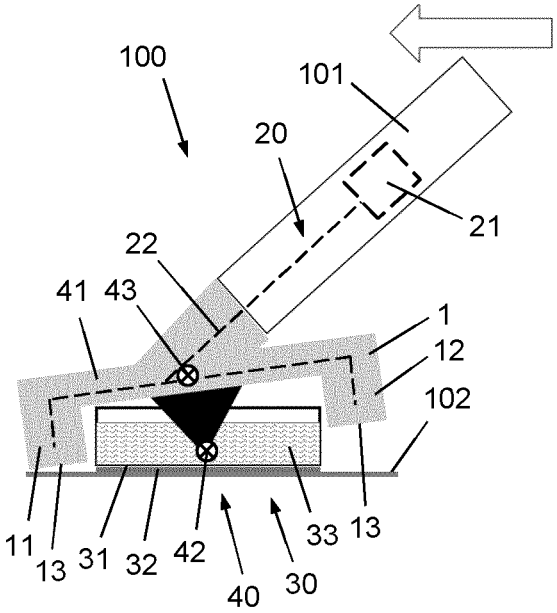
FIG. 1 diagrammatically shows a cleaning appliance comprising a nozzle arrangement according to a first embodiment of the invention, a handle and a vacuum mechanism, as moved in a forward direction, FIG. 2 diagrammatically shows the cleaning appliance of FIG. 1, as moved in a backward direction, FIG. 3 diagrammatically shows a side view of a nozzle arrangement according to a second embodiment of the invention, and a portion of a handle of a cleaning appliance connected to the nozzle arrangement, FIG. 4 diagrammatically shows a side view of a nozzle arrangement according to a third embodiment of the invention, as used in a cleaning appliance.
Figure 2:
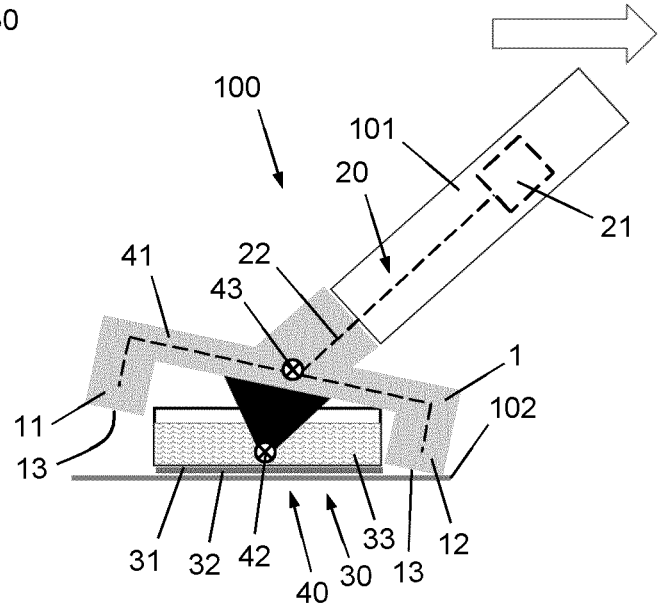

FIGS. 1 and 2 show a cleaning appliance 100 comprising a nozzle arrangement 1 according to a first embodiment of the invention. The cleaning appliance 100 further comprises a handle 101 that is connectable to the nozzle arrangement 1 for allowing a user of the cleaning appliance 100 to control the position of the nozzle arrangement 1 relative to a surface 102 to be cleaned. In particular, the user may push the cleaning appliance 100 to cause the cleaning appliance 100 to move in a forward direction, i.e. a direction away from the user, as illustrated in FIG. 1, wherein a pushing force exerted by the user is transmitted to the nozzle arrangement 1 through the handle 101, and the user may pull the cleaning appliance 100 to cause the cleaning appliance 100 to move in a backward direction, i.e. a direction towards the user, as illustrated in FIG. 2, wherein a pulling force exerted by the user is transmitted to the nozzle arrangement 1 through the handle 101. A practical example of a surface 102 to be cleaned by means of the cleaning appliance 100 according to the invention is a hard floor such as a tile floor. The connection between the handle 101 and the nozzle arrangement 1 may be of any suitable type, wherein it is practical if the connection allows for a hinging movement of the handle 101 and the nozzle arrangement 1 relative to each other, and also if the connection allows for easy detachment and attachment of the nozzle arrangement 1 and the handle 101.

The cleaning appliance 100 is designed to vacuum and mop in one go during operation. For the purpose of subjecting the surface 102 to a vacuuming action, the cleaning appliance 100 is equipped with a vacuum mechanism 20 that is configured to create underpressure at the position of the nozzle arrangement 1, particularly at the position of a first suction body 11 and a second suction body 12 thereof. The vacuum mechanism 20 is diagrammatically depicted in FIGS. 1 and 2 in a dashed fashion, and may comprise any suitable type of vacuum generator 21 and conduit system 22 extending from the vacuum generator 21 to the suction bodies 11, 12. The suction bodies 11, 12 are arranged at a distance relative to each other and may be designed as elongated channels having an open suction area 13 at a side facing the surface 102 in the shown normal, operational orientation of the nozzle arrangement 1 on the surface 102. In the shown example, the first suction body 11 is at a front position and the second suction body 12 is at a back position, assuming that the forward direction is a back to front direction, and that the backward direction a front to back direction.

For the purpose of subjecting the surface 102 to a mopping action, the nozzle arrangement 1 is equipped with a mopping assembly 30, wherein the first suction body 11 and the second suction body 12 are located on either side of the mopping assembly 30. The mopping assembly 30 comprises a mop holder 31 that is configured to support a mopping element 32 such as a piece of cloth. The mopping element 32 is intended to actually contact the surface 102 and is intended to be used in a wetted condition. It is practical if the mopping element 32 is attachable to and detachable from the mop holder 31. It is further practical if the mopping assembly 30 comprises a liquid tank 33 that is configured to contain liquid to be supplied to the mopping element 32 for putting the mopping element 32 to the wetted condition and keeping the mopping element 32 in the wetted condition throughout a cleaning action. In the shown example, the mop holder 31 and the liquid tank 33 are integrated. Consequently, in the shown example, the liquid tank 33 serves for supporting the mopping element 32.

In the first embodiment as shown in FIGS. 1 and 2, the nozzle arrangement 1 comprises a level setting mechanism 40 that is configured to put the first suction body 11 and the second suction body 12 at different overall levels relative to the surface 102 in the normal, operational orientation of the nozzle arrangement 1 on the surface 102. In particular, the level setting mechanism 40 is configured to put the first suction body 11 at a lower overall level relative to the surface 102 and the second suction body 12 at a higher overall level relative to the surface 102 when the cleaning appliance 100 is moved in the forward direction, in which case the first suction body 11 is at a leading position and the second suction body 12 is at a trailing position, as illustrated in FIG. 1, and to put the second suction body 12 at a lower overall level relative to the surface 102 and the first suction body 11 at a higher overall level relative to the surface 102 when the cleaning appliance 100 is moved in the backward direction, in which case the second suction body 12 is at a leading position and the first suction body 11 is at a trailing position, as illustrated in FIG. 2. The level setting mechanism 40 may be designed in any suitable way for responding to the force exerted on the nozzle arrangement 1 when the cleaning appliance 100 is moved in the different directions, such that a force associated with the forward movement causes the level setting mechanism 40 to put the first suction body 11 to the relatively low overall level and the second suction body 12 to the relatively high overall level, and a force associated with the backward movement causes the level setting mechanism 40 to put the second suction body 12 to the relatively low overall level and the first suction body 11 to the relatively high overall level.

It follows from the foregoing that the functionality of the level setting mechanism 40 is aimed at ensuring that the suction body 11, 12 that is at a leading position is positioned close to the surface 102 or even on the surface 102 and that the suction body 11, 12 that is at a trailing position is at a distance from the surface 102. When the movement of the cleaning appliance 100 is switched from forward to backward or from backward to forward, the position of the switching bodies 11, 12 is switched as well and the level setting mechanism 40 acts to lift the switching body 11, 12 that was at the relatively overall low level to the relatively high overall level and to lower the switching body 11, 12 that was at the relatively overall high level to the relatively low overall level. In this way, situations of the trailing suction body 11, 12 moving along a wet area of the surface 102 are avoided, which contributes to achieving excellent cleaning results, wherein striping is prevented, wherein the suction bodies 11, 12 may be kept as clean as possible, and wherein the vacuuming action remains effective due to the fact that there is always a suction body 11, 12 at an effective overall level relative to the surface 102, namely the suction body 11, 12 that is at the leading position.

In the example shown in FIGS. 1 and 2, the level setting mechanism 40 comprises a carrier 41 of the first suction body 11 and the second suction body 12 that is tiltable about a tilting axis 42 in the nozzle arrangement 1, wherein the first suction body 11 is connected to the carrier 41 at a location at one side of the tilting axis 42 and the second suction body 12 is connected to the carrier 41 at a location at the other side of the tilting axis 42 so that in the normal, operational orientation of the nozzle arrangement 1 on the surface 102, the first suction body 11 and the second section body 12 move in opposite directions relative to the surface 102 as the carrier 41 tilts. In this way, a kind of seesaw construction is obtained, which is made to tilt from one setting position to another when the direction in which the cleaning appliance 100 is moved is switched. The fact is that the tilting axis 42 is at a distance from a point 43 of application of the force on the nozzle arrangement 1 at the one hand, and also at a distance from an area of contact to the surface 102 at the position of the mopping element 32, so that the carrier 41 is subjected to torque following from the combination of the force acting at the point 43 of application and a friction force acting at the area of contact to the surface 102, which torque causes the carrier 41 to tilt between setting positions as the direction of movement changes. The carrier 41 can be provided in the form of a housing piece of the nozzle arrangement 1 of which the suction bodies 11, 12 are part, for example.

In respect of the point 43 of application of the force on the nozzle arrangement 1 mentioned in the foregoing, it is noted that this point 43 is normally at the position where the nozzle arrangement 1 is connected to the handle 101 when the nozzle arrangement 1 is used in the cleaning appliance 100. Assuming that a connection between the handle 101 and the nozzle arrangement 1 is of the type allowing for a hinging movement of the handle 101 and the nozzle arrangement 1 relative to each other, this point 43 is at another tilting axis. In general, it is noted that tilting arrangements may very well be realized through pin-in-hole constructions, which does not alter the fact that other constructions are possible as well, such as constructions involving a flexible element.

Figure 3:
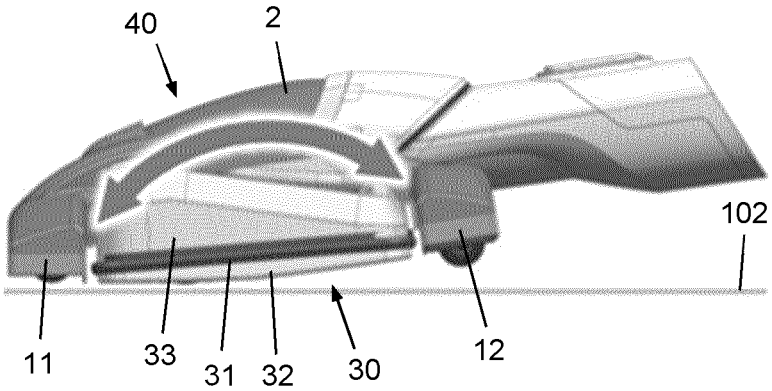

FIG. 3 shows a nozzle arrangement 2 according to a second embodiment of the invention. In this embodiment, the first suction body 11, the second suction body 12 and the components of the mopping assembly 30 are jointly movable in the nozzle arrangement 2. Further, in this embodiment, the mop holder 31 is designed so as to realize a convex outline of the mopping element 32, which facilitates a tilting movement of the components of the mopping assembly 30 over the surface 102.

FIG. 4 shows a nozzle arrangement 3 according to a third embodiment of the invention. In this embodiment, the mopping assembly 30 is removably arranged in the nozzle arrangement 3, wherein the mopping assembly 30 is attachable to and detachable from a support 34 in the nozzle arrangement 3 through a magnet connection. In the shown example, the support 34 is equipped with a magnet 35 and the mopping assembly 30 is equipped with a metal plate 36. It will be understood that other types of connection may be applied as well in the advantageous case that the mopping assembly 30 is removably arranged in the nozzle arrangement. An advantage of the magnet connection as shown is that this may facilitate the tilting arrangement of the carrier 41, particularly if the magnet 35 in the support 34 is shaped like a cylinder having a circular circumference, as can best be seen in the enlarged view of the components of the magnet connection in FIG. 5, in which the case a central longitudinal axis of the magnet 35 may define the tilting axis 42.

FIG. 6 shows a conduit system 22*a* as present in a nozzle arrangement, which is part of the conduit system 22 of the vacuum mechanism 20 of the cleaning appliance 100, and also shows the mopping element 32 located between the two suction bodies 11, 12 of the nozzle arrangement. It is a known fact that the larger a total open suction area of a vacuum mechanism is, the lower the suction performance at a given airflow is. The invention provides measures to at least partially close a suction body 11, 12 to one of the surface 102 and an internal air conduit of the nozzle arrangement in order to obtain as high as possible suction performance under all possible circumstances. Advantageously, the measures involve a functionality of at least partially closing a suction body 11, 12 during the time that a suction body 11, 12 is not needed in a vacuuming action, or needed to a lesser extent compared to full suction capacity. Realizing closure of a suction body 11, 12 can be done at the level of the open suction area 13 of the suction body 11, 12 or at any other suitable level deeper in the conduit system 22*a*.

With reference to FIGS. 7-11, various options in respect of a suction enhancing mechanism 50 for at least partially closing at least one of the first suction body 11 and the second suction body 12 to one of the surface 102 and an internal air conduit of the nozzle arrangement will now be explained, wherein it is noted that it may particularly be advantageous if the suction enhancing mechanism 50 is configured to at least partially close the second suction body 12 while leaving the first suction body 11 open in the case of forward movement, and to at least partially close the first suction body 11 while leaving the second suction body 12 open in the case of backward movement. As already explained in relation to the functionality of the level setting mechanism 40, the force associated with the forward or the backward movement of the nozzle arrangement can be used to cause movement of one or more components in the nozzle arrangement. Hence, it is possible to have a suction enhancing mechanism 50 that acts in response to the force, in a mechanical fashion.

It is to be noted that the nozzle arrangement can be equipped with both the level setting mechanism 40 and the suction enhancing mechanism 50, but that this is not necessary. Thus, it is also possible to have an embodiment of the nozzle arrangement in which the level setting mechanism 40 is present and from which the suction enhancing mechanism 50 is omitted. In the case that the nozzle arrangement is equipped with both the level setting mechanism 40 and the suction enhancing mechanism 50, it may be so that the suction enhancing mechanism 50 is arranged to be controlled by the level setting mechanism 40, wherein it may particularly be so that movement of one or more components of the suction enhancing mechanism 50 is caused by movement of one or more components of the level setting mechanism 40 in a predetermined way.

Figure 8:
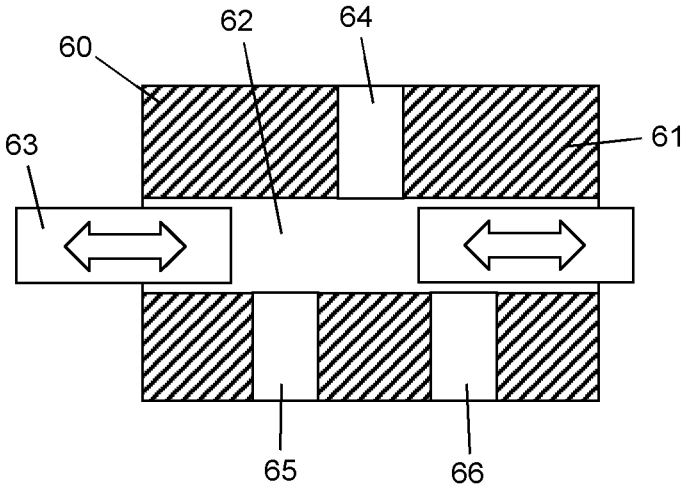

FIG. 7 shows a nozzle arrangement 4 according to a fourth embodiment of the invention. In this embodiment, the suction enhancing mechanism 50 comprises a valve arrangement 60 of the slider type as separately shown in FIG. 8. The valve arrangement 60 comprises a channel body 61 having a central space 62 in which a valve body 63 is slidably arranged. The channel body 61 further has three channels 64, 65, 66 in communication with the central space 62, a first one 64 of the channels 64, 65, 66 being configured to be connected to a common conduit 23 of the conduit system 22*a*, a second one 65 of the channels 64, 65, 66 being configured to be connected to a conduit 24 of the conduit system 22*a* extending to the first suction body 11, and a third one 66 of the channels 64, 65, 66 being configured to be connected to a conduit 25 of the conduit system 22*a* extending to the second suction body 12. The suction enhancing mechanism 50 is designed such that a pushing force exerted on the nozzle arrangement 4 causes the valve body 63 to be positioned for opening the second channel 65 to the first channel 64 while closing the third channel 66 to the first channel 64, so that the first suction body 11 is opened while the second suction body 12 is not, and that a pulling force exerted on the nozzle arrangement 4 causes the valve body 63 to be positioned for opening the third channel 66 to the first channel 64 while closing the second channel 65 to the first channel 64, so that the second suction body 12 is opened while the first suction body 11 is not. For the sake of completeness, it is noted that FIG. 8 shows the first-mentioned position of the valve body 63.

Figure 9:
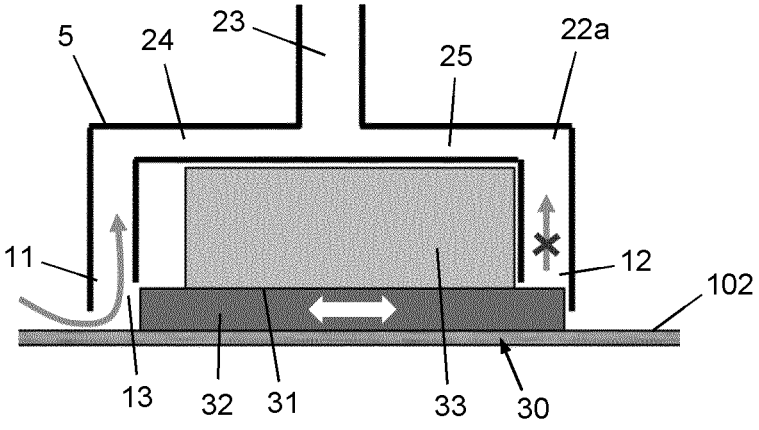

FIG. 9 shows components of a nozzle arrangement 5 according to a fifth embodiment of the invention, particularly the conduit system 22*a* and the mopping assembly 30. In this embodiment, the mopping assembly 30 is slidably arranged in the nozzle arrangement 5, so that under the influence of friction to the surface 102, the mopping assembly 30 slides back and forth in the nozzle arrangement 5 as the nozzle arrangement 5 is alternately moved in the forward direction and the backward direction, as a result of which the mopping assembly 30 functions to close the suction body 11, 12 at the trailing position to the surface 102. Closing of the relevant one of the suction body 11, 12 may easily and directly be done when a portion of the mop holder 31 and the mopping element 32 arranged thereon projects sidewards from the liquid tank 33 at both sides of the liquid tank 33 and is dimensioned to slide between the suction body 11, 12 and the surface 102. FIG. 9 illustrates a situation in which the second suction body 12 is at the trailing position, and in which, consequently, the mopping assembly 30 is in a position of closing the second suction body 12. By means of a curved arrow at the position of the first suction body 11, it is indicated that in this situation, a flow of air through the first suction body 11 is enabled. Further, by means of a crossed arrow at the position of the second suction body 12, it is indicated that in this situation, a flow of air through the second suction body 12 is disabled.

Figure 10:
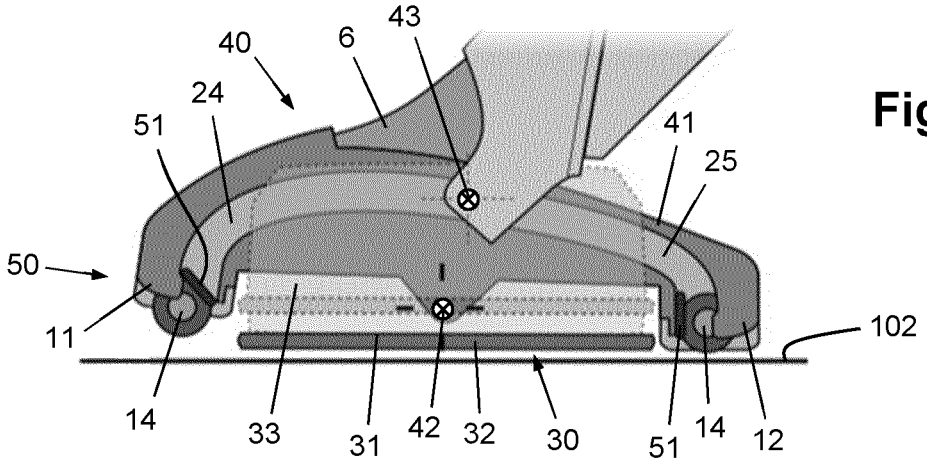

FIG. 10 shows a nozzle arrangement 6 according to a sixth embodiment of the invention. In this embodiment, the nozzle arrangement 6 comprises a level setting mechanism 40 including a tiltable carrier 41 of the first suction body 11 and the second suction body 12. Further, in this embodiment, the mopping assembly 30 is fixedly arranged in the nozzle arrangement 6, and the carrier 41 tilts from one setting position to another over the mopping assembly 30 when the nozzle arrangement 6 is made to move forward and backward. At the position of the open suction area 13 of each of the first suction body 11 and the second suction body 12, a shutter element 51 is arranged, which shutter element 51 is arranged to be pressed to a position for leaving the suction body 11, 12 open to the surface 102 by means of at least one wheel 14 that is arranged to support the nozzle arrangement 6 on the surface 102 at the position of the suction body 11, 12 when the suction body 11, 12 is at the relatively low overall level relative to the surface 102, and to be in a default position for closing the suction body 11, 12 to the surface 102 when the suction body 11, 12 is at the relatively high overall level relative to the surface 102. Thus, a suction body 11, 12 that is moved towards the surface 102 is opened from the moment the at least one wheel 14 touches the surface 102 and is closed again when the suction body 11, 12 is made to move away from the surface 102 and contact between the surface 102 and the at least one wheel 14 is lost. In this way, it is achieved that under all circumstances, only the suction body 11, 12 that is in the leading position is opened to the surface 102, while the other suction body 11, 12, i.e. the suction body 11, 12 that is in the trailing position, is closed to the surface 102.

Figure 11:
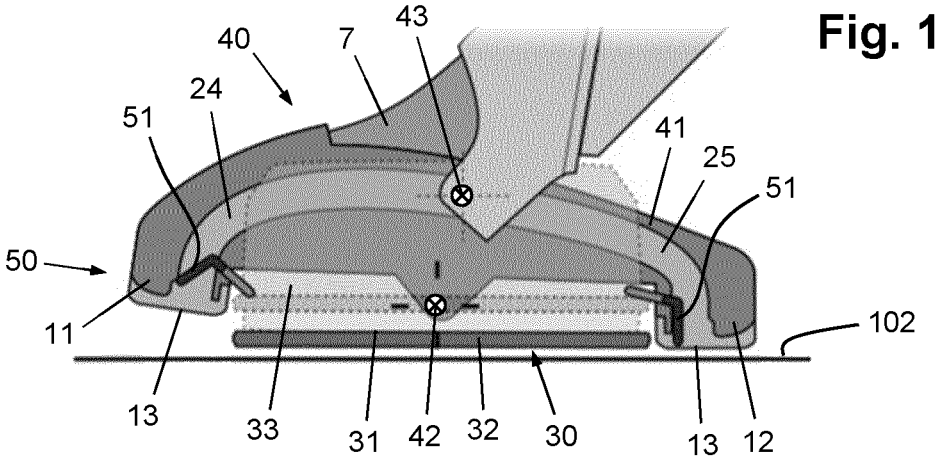

FIG. 11 shows a nozzle arrangement 7 according to a seventh embodiment of the invention, which resembles the nozzle arrangement 6 according to the sixth embodiment of the invention to a large extent. A difference to the nozzle arrangement 6 according to the sixth embodiment of the invention resides in the fact that the shutter elements 51 are not moved under the influence of wheels 14, but under the influence of whether or not contact to the mopping assembly 30 is made. The shutter elements 51 are normally in a position of closing the suction bodies 11, 12, wherein it is practical if this is realized by biasing the shutter elements 51 towards the position as mentioned under the influence of springs or other suitable biasing means. Further, the shutter elements 51 are arranged such that a movement in the level setting mechanism 40 which causes one of the suction bodies 11, 12 to be lifted from the relatively low overall level to the relatively high overall level and the other of the suction bodies 11, 12 to be lowered from the relatively high overall level to the relatively low overall level also causes the shutter element 51 of the one of the suction bodies 11, 12 to lose contact to the mopping assembly 30 and to be moved from a position of opening the suction body 11, 12 to the surface 102 to a position of closing the suction body 11, 12 to the surface 102, and to cause the shutter element 51 of the other of the suction bodies 11, 12 to contact the mopping assembly 30 and to be moved from a position of closing the suction body 11, 12 to the surface 102 to a position of opening the suction body 11, 12 to the surface 102. In this way, it is achieved that under all circumstances, only the suction body 11, 12 that is in the leading position is opened to the surface 102, while the other suction body 11, 12, i.e. the suction body 11, 12 that is in the trailing position, is closed to the surface 102. It may be practical if the mopping assembly 30 is provided with something like a rim, local projections or another type of defined element(s) for engaging with the shutter elements 51.

Generally speaking, in case the nozzle arrangement is of the type as shown in FIGS. 10 and 11, the suction enhancing mechanism 50 comprises shutter elements 51 configured to be moved between positions of opening and at least partially closing the suction bodies 11, 12, wherein a change of position of the shutter elements 51 is caused by a movement in the level setting mechanism 40. It is practical if the shutter elements 51 are arranged such that they are activated to move under the influence of contact to one or more other components of the nozzle arrangement, wherein it may be so that biasing means may be applied for moving the shutter elements 51 to a default position when contact to the one or more other components of the nozzle arrangement is lost, which default position may be either one of a position for opening the suction body 11, 12 and a position of closing the suction body 11, 12, whatever is appropriate in a given embodiment.

It will be clear to a person skilled in the art that the scope of the invention is not limited to the examples discussed in the foregoing, but that several amendments and modifications thereof are possible without deviating from the scope of the invention as defined in the attached claims. It is intended that the invention be construed as including all such amendments and modifications insofar they come within the scope of the claims or the equivalents thereof. While the invention has been illustrated and described in detail in the figures and the description, such illustration and description are to be considered illustrative or exemplary only, and not restrictive. The invention is not limited to the disclosed embodiments. The drawings are schematic, wherein details which are not required for understanding the invention may have been omitted, and not necessarily to scale.

Variations to the disclosed embodiments can be understood and effected by a person skilled in the art in practicing the claimed invention, from a study of the figures, the description and the attached claims. In the claims, the word "comprising" does not exclude other steps or elements, and the indefinite article "a" or "an" does not exclude a plurality. Any reference signs in the claims should not be construed as limiting the scope of the invention.

Elements and aspects discussed for or in relation with a particular embodiment may be suitably combined with elements and aspects of other embodiments, unless explicitly stated otherwise. Thus, the mere fact that certain measures are recited in mutually different dependent claims does not indicate that a combination of these measures cannot be used to advantage.

The terms "comprise" and "include" as used in this text will be understood by a person skilled in the art as covering the term "consist of". Hence, the term "comprise" or "include" may in respect of an embodiment mean "consist of", but may in another embodiment mean "contain/have/be equipped with at least the defined species and optionally one or more other species".

Notable aspects of the invention are summarized as follows. A nozzle arrangement 1, 2, 3, 4, 5, 6, 7 that is configured to face a surface 102 to be cleaned comprises a first suction body 11 and a second suction body 12 located at a distance relative to each other. Both the first suction body 11 and the second suction body 12 are configured to be operated to suck dust and dirt from the surface 102 to be cleaned. The nozzle arrangement 1, 2, 3, 4, 5, 6, 7 further comprises a level setting mechanism 40 that is configured to put the first suction body 11 and the second suction body 12 at different overall levels relative to the surface 102 to be cleaned in a normal, operational orientation of the nozzle arrangement 1, 2, 3, 4, 5, 6, 7 on the surface 102. In this way, cleaning performance of the nozzle arrangement 1, 2, 3, 4, 5, 6, 7 can be improved. Additionally or alternatively, it is possible to have a suction enhancing mechanism 50 for at least partially closing at least one of the first suction body 11 and the second suction body 12 to one of the surface 102 to be cleaned and an internal air conduit 23, 24, 25 of the nozzle arrangement 1, 2, 3, 4, 5, 6, 7.

The invention claimed is:

1. A nozzle arrangement configured to face a surface to be cleaned, comprising:

a first suction body and a second suction body located at a distance relative to each other, wherein both the first suction body and the second suction body are configured to be operated to suck dust and dirt from the surface to be cleaned, and wherein both the first suction body and the second suction body are connectable to a vacuum mechanism configured to create underpressure at a position of the first suction body and the second suction body;

a level setting mechanism configured to put the first suction body and the second suction body at different overall levels relative to the surface to be cleaned in a normal, operational orientation of the nozzle arrangement on the surface; and a suction enhancing mechanism configured to partially close one of the first suction body and the second suction body to one of the surface to be cleaned and an internal air conduit of the nozzle arrangement during a forward movement or a backward movement of the nozzle arrangement, respectively, and wherein the suction enhancing mechanism is configured to at least partially close the second suction body while leaving the first suction body open when the nozzle arrangement is subjected to a force related to a movement of the nozzle arrangement with the first suction body at a leading position and the second suction body at a trailing position.

2. The nozzle arrangement according to claim 1, wherein the level setting mechanism is configured to put the first suction body at a lower overall level relative to the surface to be cleaned and the second suction body at a higher overall level relative to the surface to be cleaned when the nozzle arrangement is subjected to the force related to the movement of the nozzle arrangement with the first suction body at the leading position and the second suction body at the trailing position, and to put the second suction body at a lower overall level relative to the surface to be cleaned and the first suction body at a higher overall level relative to the surface when the nozzle arrangement is subjected to a force related to a movement of the nozzle arrangement with the second suction body at a leading position and the first suction body at a trailing position.

3. The nozzle arrangement according to claim 1, wherein the level setting mechanism comprises an element interconnecting the first suction body and the second suction body, wherein the element is movably arranged in the nozzle arrangement.

4. The nozzle arrangement according to claim 1, wherein the level setting mechanism comprises a carrier of the first suction body and the second suction body that is tiltable about a tilting axis in the nozzle arrangement, and wherein the first suction body is connected to the carrier at a location at one side of the tilting axis and the second suction body is connected to the carrier at a location at the other side of the tilting axis so that in the normal, operational orientation of the nozzle arrangement on the surface to be cleaned, the first suction body and the second suction body move in opposite directions relative to the surface as the carrier tilts.

5. The nozzle arrangement according to claim 1, further comprising a mopping assembly configured to perform a mopping action on the surface to be cleaned when the nozzle arrangement is moved along the surface to be cleaned, wherein the first suction body and the second suction body are located on either side of the mopping assembly.

6. The nozzle arrangement according to claim 5, wherein the mopping assembly comprises a mop holder configured to support a mopping element configured to be wetted, and wherein the mopping element is attachable to and detachable from the mop holder.

7. The nozzle arrangement according to claim 6, wherein the first suction body, the second suction body and at least a component of the mopping assembly are jointly movable in the nozzle arrangement.

8. The nozzle arrangement according to claim 6, wherein the mopping assembly further comprises a liquid tank configured to contain liquid to be supplied to the mopping element for wetting the mopping element.

9. The nozzle arrangement according to claim 8, wherein the mop holder and the liquid tank are integrated.

10. The nozzle arrangement according to claim 5, wherein the mopping assembly is removably arranged in the nozzle arrangement.

11. The nozzle arrangement according to claim 10, wherein the mopping assembly is attachable to and detachable from a support in the nozzle arrangement through a magnet connection, and wherein at least one of the mopping assembly and the support is equipped with at least one magnet.

12. The nozzle arrangement according to claim 1, wherein the suction enhancing mechanism is configured to at least partially close the first suction body while leaving the second suction body open when the nozzle arrangement is subjected to a force related to a movement of the nozzle arrangement with the second suction body at a leading position and the first suction body at a trailing position.

13. The nozzle arrangement according to claim 12, wherein the suction enhancing mechanism is arranged to be controlled by the level setting mechanism.

14. A cleaning appliance, comprising:

a nozzle arrangement according to claim 1, a handle that is connectable to the nozzle arrangement for allowing a user of the cleaning appliance to control a position of the nozzle arrangement relative to a surface to be cleaned, and a vacuum mechanism configured to create underpressure at the position of the first suction body and the second suction body of the nozzle arrangement.

15. The nozzle arrangement according to claim 1, wherein the suction enhancing mechanism is configured to control an opened condition or a closed condition of the at least one of the first suction body and the second suction body based at least in part on a direction of a force exerted on the nozzle arrangement for moving the nozzle arrangement.

16. The nozzle arrangement according to claim 13, wherein the suction enhancing mechanism is further configured to control a size of suction area defined by the first suction body and the second suction body based at least in part on a position of one or more components of the level setting mechanism.

* * * * *